US009453307B2

(12) United States Patent
Gsodam et al.

(10) Patent No.: US 9,453,307 B2
(45) Date of Patent: Sep. 27, 2016

(54) RAIL SWITCH HAVING A MAIN TRACK AND A BRANCH TRACK

(71) Applicants: voestalpine Weichensysteme GmbH, Zeltweg (AT); voestalpine VAE GmbH, Vienna (AT)

(72) Inventors: Johann Gsodam, Reichenfels (AT); Heinz Ossberger, Grosslobming (AT)

(73) Assignees: VOESTALPINE WEICHENSYSTEME GMBH, Zeltweg (AT); VOESTALPINE VAE GMBH, Vienna (AT)

( * ) Notice: Subject to any disclaimer, the term of this patent is extended or adjusted under 35 U.S.C. 154(b) by 27 days.

(21) Appl. No.: 14/382,575

(22) PCT Filed: Feb. 12, 2013

(86) PCT No.: PCT/AT2013/000025
§ 371 (c)(1),
(2) Date: Dec. 22, 2014

(87) PCT Pub. No.: WO2013/131112
PCT Pub. Date: Sep. 12, 2013

(65) Prior Publication Data

US 2015/0167250 A1 Jun. 18, 2015

(30) Foreign Application Priority Data

Mar. 9, 2012 (AT) ..... A 294/2012

(51) Int. Cl.
*E01B 7/00* (2006.01)
*E01B 7/02* (2006.01)

(52) U.S. Cl.
CPC ..... *E01B 7/02* (2013.01)

(58) Field of Classification Search
CPC ..... E01B 7/00; E01B 7/02; E01B 7/10; E01B 7/24
See application file for complete search history.

(56) References Cited

U.S. PATENT DOCUMENTS 1,177,670 A * 4/1916 Woods et al. ..... B61F 9/00 246/436
4,224,875 A * 9/1980 Knippel ..... B61F 9/00 104/130.01

(Continued)

FOREIGN PATENT DOCUMENTS

| | | | |
|---|---|---|---|
| DE | 487 877 | C | 12/1929 |
| DE | 1 000 415 | B | 1/1957 |
| DE | 2 046 391 | A1 | 3/1972 |
| EP | 0 040 533 | A2 | 11/1981 |
| EP | 0 295 573 | A1 | 12/1988 |
| WO | 2004/003295 | A1 | 1/2004 |

OTHER PUBLICATIONS

International Search Report dated Jun. 5, 2013, issued in International Application PCT/AT2013/000025.
International Preliminary Examination Reports issued in International Application PCT/AT2013/000025.

*Primary Examiner* — Jason C Smith
(74) *Attorney, Agent, or Firm* — Fitch, Even, Tabin & Flannery LLP

(57) ABSTRACT

In a railway switch with a main track and a branch track, in which one rail of each track is each configured as a tongue rail and movable into abutment on the respective stock rail, the stock rail comprises in the region of the abutment on the tongue rail a deviating course of the running edge and the running edge of the tongue rail comprises a curve progression, whose imaginary extension comprises an overcutting or an undercutting with the running edge of the stock rail.

13 Claims, 6 Drawing Sheets

(56) References Cited

U.S. PATENT DOCUMENTS

| | | | | | |
|---|---|---|---|---|---|
| 4,925,135 | A * | 5/1990 | Ziethen | E01B 7/00 | 246/436 |
| 5,224,672 | A * | 7/1993 | Testart | E01B 9/00 | 104/130.01 |
| 5,375,797 | A * | 12/1994 | Willow | E01B 7/02 | 246/415 R |
| 5,590,833 | A * | 1/1997 | Benenowski | E01B 11/42 | 238/171 |
| 6,543,728 | B1 * | 4/2003 | Benenowski | E01B 7/10 | 246/454 |
| 7,387,280 | B2 | 6/2008 | Fritz et al. | | |
| 8,424,813 | B1 * | 4/2013 | Voelkerding | E01B 7/10 | 246/274 |
| 8,872,055 | B2 * | 10/2014 | Reichle | E01B 7/24 | 104/279 |
| 2006/0097115 | A1 * | 5/2006 | Fritz | E01B 7/02 | 246/435 R |
| 2015/0167250 | A1 * | 6/2015 | Gsodam | E01B 7/02 | 246/435 R |

* cited by examiner

RAIL SWITCH HAVING A MAIN TRACK AND A BRANCH TRACK

CROSS-REFERENCE TO RELATED APPLICATIONS

This Application is a U.S. National Stage Application filed under 35 U.S.C. §371 of International Application PCT/AT2013/000025, filed Feb. 12, 2013, designating the United States, which claims priority from Austrian Patent Application A 294/2012, filed Mar. 9, 2012, the complete disclosures of which are hereby incorporated herein by reference in their entirety for all purposes.

The invention relates to a railway switch with a main track and a branch track, wherein one rail of each track is each configured as a tongue rail and movable into abutment on the respective stock rail.

When passing a switch, high forces act upon the rails, particularly high transverse forces that are dependent, in particular, on the curvature radius and the deflection angle of the switch, on the speed, at which the switch is passed and on the axle load. These transverse forces need to be largely absorbed by the tongue rail, wherein particularly high loads occur, in particular, on similar flexure turnouts, in which the branch track branches off a curved main track toward the inner side of the curve, due to the high inertial and centrifugal forces. This leads to increased wear of the tongue rail such that its service life is significantly reduced. In addition, modern switches have to be passable at very high speeds such that the tongue rails inevitably have long and thin tips and therefore are more susceptible to wear. Consequently, it was already proposed several times to manufacture tongue rails of particularly wear-resistant materials or to harden tongue rails by means of subsequent treatments.

In the past, tongue rails that are realized with an increased thickness in order to reliably absorb transverse forces have also been proposed. For example, DE-OS 2,046,391 discloses tongue rails, the tongue ends of which feature reinforcements in the direction toward the stock rails, wherein recesses on the running edge of the stock rail correspond to said reinforcements. In the state in which it abuts on the stock rail, the tongue rail engages into the recesses of the stock rail such that a continuous running edge is formed in the region of the transition from the stock rail to the tongue rail. However, the stock rail is weakened in this case. Furthermore, EP 40533 A2 proposes to reduce the width of the stock rail in its head area and in its base area in the region, in which the tongue rail abuts on the stock rail, such that the tongue rail can be realized in accordance with the rail head profile in the region of this transition. However, the profile of the stock rail is also significantly weakened in this solution such that the risk of fracture is increased. In order to prevent an excessive reduction of the cross section of the stock rail while still achieving an adequate reinforcement of the tongue rail, the rail head profile of the stock rail is frequently milled off obliquely downward in the tongue abutment region as described, for example, in DE-PS 487877.

Another approach is disclosed in WO 2004/003295 A1, in which a special progression of the stock rail mill-off and a shape of the tongue rail that corresponds to the mill-off are proposed.

All in all, however, prior proposals for reinforcing the cross section of the tongue rail, particularly for heavy goods vehicle traffic, are not entirely sufficient because an additional improvement of the wear resistance of the tongue rails is desired in many instances and a reduced stability of the stock rail furthermore results due to the material removal on the running edge of the stock rail.

The invention therefore is based on the objective of additionally reducing the wear on the tongue rail and simultaneously ensuring high operational reliability and high traveling comfort.

According to the invention, this objective is solved by enhancing a railway switch of the initially cited type to the effect that the stock rail comprises a deviating course of the running edge in the abutment region of the tongue rail and the running edge of the tongue rail comprises a curve progression, whose imaginary extension comprises an overcutting or undercutting with the running edge of the stock rail.

In this case, the deviation of the course of the running edge is realized in the sense of a temporary widening of the rail gauge, wherein this can be realized in different ways. In a first embodiment, one side of the stock rail head may be processed by means of material removal in the region of the abutment on the tongue rail such that an asymmetric rail head profile with a smaller width than the original profile results. In a second embodiment, the stock rail may be deflected from the rail progression in the region of the abutment on the tongue rail such that a bulge is formed. In both instances, it is advantageous if the running edge of the stock rails is thusly shifted relative to the original progression by at least 10 mm, particularly by 10-15 mm, at the point of maximum deviation of the running edge.

In both instances, the deviation of the progression of the running edge creates space for tongue rail tips that are reinforced in comparison with a conventional tongue rail in the region of the abutment on the stock rail. In the second embodiment with the bulging stock rail, this space advantageously is not only made available by milling out the stock rail in the region of the running edge, wherein this always involves material removal and therefore weakening of the stock rail. The additional space for a tongue rail tip that is reinforced in the region of the abutment rather is kept clear by deflecting the stock rail from the rail progression, wherein this rail progression refers to the imaginary extension of the stock rail without the bulge. In this second embodiment, the stock rail therefore is actually deflected in the region of the abutment on the tongue rail and deflected back into the imaginary progression at the end of the abutment region of the tongue rail such that the running edge of the stock rail is also provided with a corresponding bulge. With the exception of the conventional mill-outs in the abutment region of the tongue rail, the stock rail respectively has in the region of the bulge the same profile shape or the same cross section as before and after the bulge.

In order to also achieve a wear resistance of the tongue rail tip that is improved in comparison with the prior art, the invention furthermore proposes that the imaginary extension of the curve progression of the running edge of the tongue rail features an overcutting or an undercutting with the running edge of the stock rail. With respect to the geometry of the overcutting or undercutting of a tongue rail, we refer to the definition in STANDARD EN 13232-1. In the overcutting design, as well as in the undercutting design, the tongue rail does not extend toward the stock rail in the sense of a tangential switch design. In the overcutting design, the tongue rail rather is realized in such a way that the imaginary curve progression of the tongue rail extends into the region of the stock rail. In the undercutting design, the tongue rail is realized in such a way that the imaginary curve progression of the tongue rail remains spaced apart from the stock rail. In both instances, the tongue rail branches off the stock rail in a much steeper fashion, i.e., with a greater deflection angle, than in a tangential extent toward the stock rail as described, for example, in WO 2004/003295 A1 such that a relatively thick profile of the tongue rail is already achieved in the region, in which the tongue rail extends out of the space of the bulge and which also represents the region, on which the wheel flanges of a rail vehicle traveling through the railway switch impact, and the tongue rail is more resistant and therefore less susceptible to wear in this region. The greater deflection angle furthermore results in a significantly shorter design of the switch.

The greater deflection angle achieved by means of the overcutting or undercutting design of the curve progression of the tongue rail would lead to inferior traveling comfort with conventional switch constructions. According to the invention, however, this inferior traveling comfort is compensated by the deviating course of the running edge of the stock rail in the region of the tongue rail abutment, wherein an effect of the type explicitly described in EP 295573 A1 results. The invention therefore makes it possible to increase the deflection angle such that the tongue rail thickness is increased in the impact region of the wheel flanges and the structural length of the switch is shortened without compromising the traveling comfort.

According to a preferred enhancement, the traveling comfort is additionally improved in that the tongue rail features an end section with a linearly extending running edge that follows the curve progression. In this case, the linear running edge of the end section preferably follows the curve progression tangentially such that the tongue rail tip is reinforced.

In order to ensure largely optimal wear properties on the one hand and acceptable traveling comfort on the other hand, the invention is preferably enhanced to the effect that the running edge of the tongue rail includes a deflection angle of 0.3° to 0.8°, preferably 0.4°, with the running edge of the stock rail. Up to a certain point, an obtuse angle of the tongue rail leads to improved wear properties, but the traveling comfort of the railway switch rapidly deteriorates. The applicant determined the defined values for the secant angle as optimal for a satisfactory compromise between the aforementioned aspects.

It is preferred that the tongue rail has in the abutment region a shape that corresponds to the deviating course of the running edge of the stock rail, particularly to the bulge, such that a gentle load transmission from the tongue rail to the stock rail is achieved while a rail vehicle travels through the railway switch and, in particular, the space created due to the deviation of the running edge is optimally utilized for realizing the abutment region of the tongue rail with the greatest material thickness possible.

A tongue rail tip that is tapered particularly thin naturally is subjected to rapid wear. Consequently, the invention preferably is realized in such a way that the tongue rail has a flattened tip, wherein this results in the tongue rail tip having a relatively large material thickness from the beginning and therefore only being subjected to relatively little wear. In order to additionally minimize the wear and to improve the comfort, the invention is in this case preferably enhanced to the effect that the tip of the tongue rail lies within the bulge of the stock rail when the tongue rail is in abutment on the stock rail. In such an embodiment, the wheel flange of a track wheel does not impact on the tongue rail tip because it is situated within the bulge of the stock rail. The wheel flange only comes in contact with the tongue rail in a region that lies behind the tip thereof such that a more gentle deflection of the wheel flange takes place.

The invention is described in greater detail below with reference to exemplary embodiments that are illustrated in the drawings. In these drawings, FIG. 1 shows a non-inventive design, in which the curve progression of a tongue rail tangentially extends toward a stock rail with a bulge;

FIGS. 1, 2, 6 and 7 should by no means be interpreted in the form of true-to-scale illustrations. In fact, certain dimensions were exaggerated in order to elucidate the characteristics essential for comprehending the invention.

Figure 1:
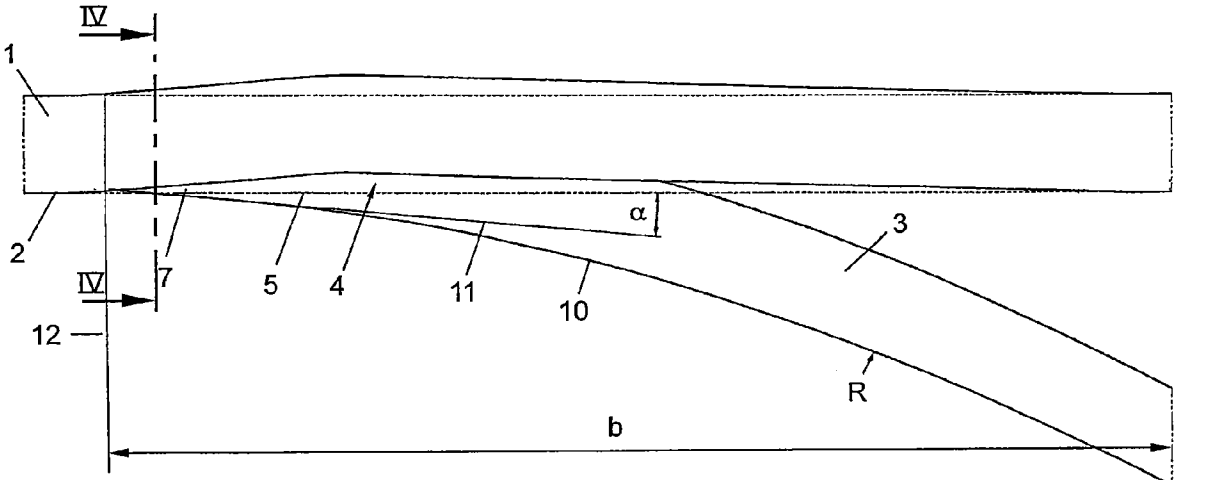

In FIG. 1, the reference symbol 1 identifies a straight stock rail of a railway switch, the running edge of which is identified by the reference symbol 2. The stock rail 1 basically extends straight and accordingly has a straight running edge 2. The running edge of the rail is usually positioned at the widest point of the rail head and measured at a vertical distance from the top of the rail that is either predefined or specified in a corresponding standard. The width of the stock rail head is in this case usually measured at a vertical distance of 10 to 20 mm, particularly 14 mm, from the top of the rail.

In the abutment region of the tongue rail 3, the stock rail 1 is deflected from its straight progression such that it features a bulge 4 and the progression of the running edge 2 also deviates from the imaginary, continuously straight progression 5 in this region. With the exception of conventional mill-outs in the region of the tongue rail abutment, the rail profile also remains completely intact in the region of the bulge 4. The tongue rail 3 features a running edge 10 that in the illustration according to FIG. 1 tangentially extends toward the respective running edge or 5 of the stock rail 1. This means that the respective curve progression of the tongue rail 3 or the running edge 10 is tangentially adapted to the imaginary, continuously straight progression 5 of the running edge 2 of the stock rail 1.

The design of the switching device with a bulging stock rail 1 according to FIG. 1 is also referred to as KGO® (kinematic gauge optimization). In this design, the traveling comfort is optimized as described below. An ideal harmonic motion basically is adjusted while the rail vehicle travels along a track due to the contours of the wheels and the rails. However, this harmonic motion is disturbed when the wheel enters the switching device of a conventional switch. The wheel axle of a rail vehicle is abruptly positioned inclined such that the wheel flange impacts on the running edge of the tongue rail. The wheel flange grinds along the tongue rail. This results in significant wear on the wheel and the rail and in inferior traveling comfort. Since the stock rail features a bulge of up to 15 mm, preferably 10-15 mm, the contact points between wheel and rail lie at about the same point of the wheel cones on both sides of an axle traveling through the railway switch. An optimal axle control in the switching device therefore is ensured. The harmonic motion from the track is nearly continued in the switch. An impact of the wheel flange on the tongue rail is respectively prevented or reduced to a minimum. Due to the bulge of the stock rails, the tongue rails become thicker in the region of the tip and therefore have a greater stability and an increased wear resistance. The traveling comfort is significantly improved because abrupt motions are prevented when entering the switching device.

The switching device illustrated in FIG. 2 features a bulge 4 of the type described with reference to FIG. 1, wherein this bulge has the same technical effect as described above. In this respect, we therefore refer to the description of FIG. 1. In contrast to the embodiment according to FIG. 1, the tongue rail 3 abutting in the region of the bulge 4 does not extend toward the stock rail 1 tangentially, but rather in such a way that, according to the invention, the imaginary extension 6 of the curve progression of the running edge 10 of the tongue rail 3 illustrated with broken lines cuts across the cutting edge 2 of the stock rail 1. The overcutting dimension is identified by the reference symbol a and denotes how far the contact point between the imaginary extension 6 and a line extending parallel to the running edge 2 is shifted rearward in comparison with the tangential design of the tongue rail (FIG. 1). In other words, the overcutting dimension a is the dimension of the overcutting of the imaginary extension 6 that is reached in the point, in which the tangent on the imaginary extension 6 extends parallel to the running edge 2 of the stock rail 1. Due to the overcutting, the deflection angle a of the tongue rail 3 is greater than in FIG. 1 and the structural length b of the switch, i.e., the distance between the tongue rail beginning 12 and the frog point 13, therefore is shorter. In this context, the deflection angle a refers to the angle included by a tangent 11 placed on the running edge 10 at the end of the curved progression of the running edge 10 and the respective imaginary running edge 5 or 2 of the stock rail.

Due to the overcutting design of the running edge 10, the tongue rail 3 already has a greater material thickness than in the embodiment according to FIG. 1 in the region, in which the wheel flange of a wheel traveling through the switch contacts the tongue rail 3, such that the wear of the tongue rail 3 is reduced. This can be clearly ascertained by comparing the cross-sectional illustrations in FIGS. 4 and 5, in which the size or thickness of the tongue rail 3 in the plane of the running edge is identified by the reference symbol c.

Figure 2:
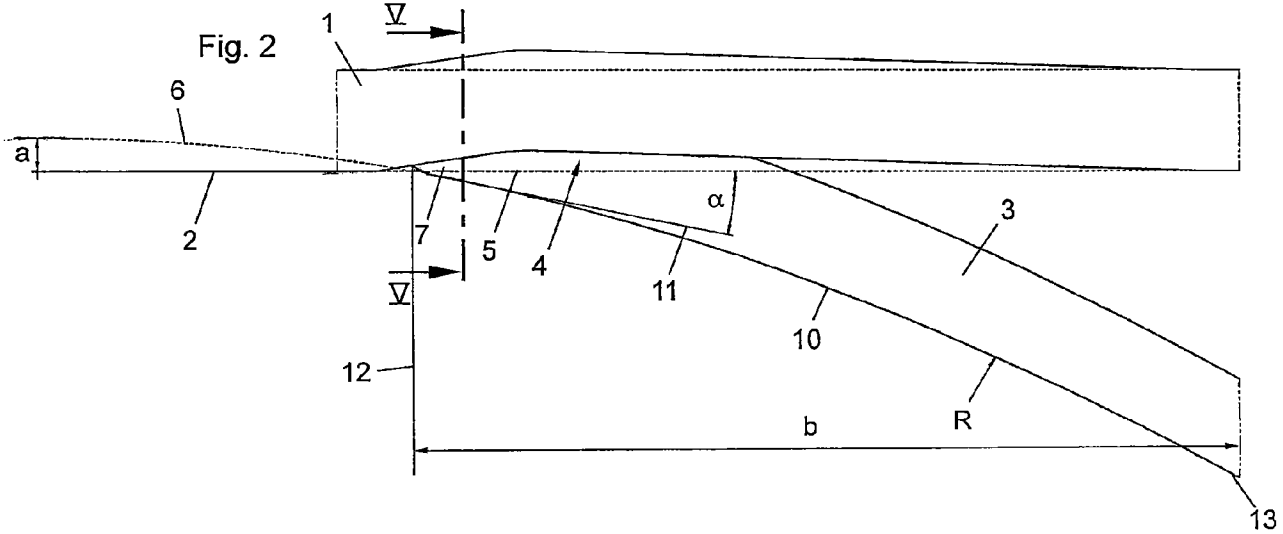
FIG. 2 shows a first exemplary embodiment of the invention.

FIG. 2 furthermore shows that the running edge 10 of the tongue rail 3 features in the region of the tongue rail tip 7 a linear end section 14 that tangentially follows the curve progression of the running edge 10. This means that the tongue rail tip 7 linearly deviates from a curve-shaped progression in the frontmost region such that a greater deflection angle results. This is illustrated more clearly in the detail according to FIG. 3.

Figure 3:
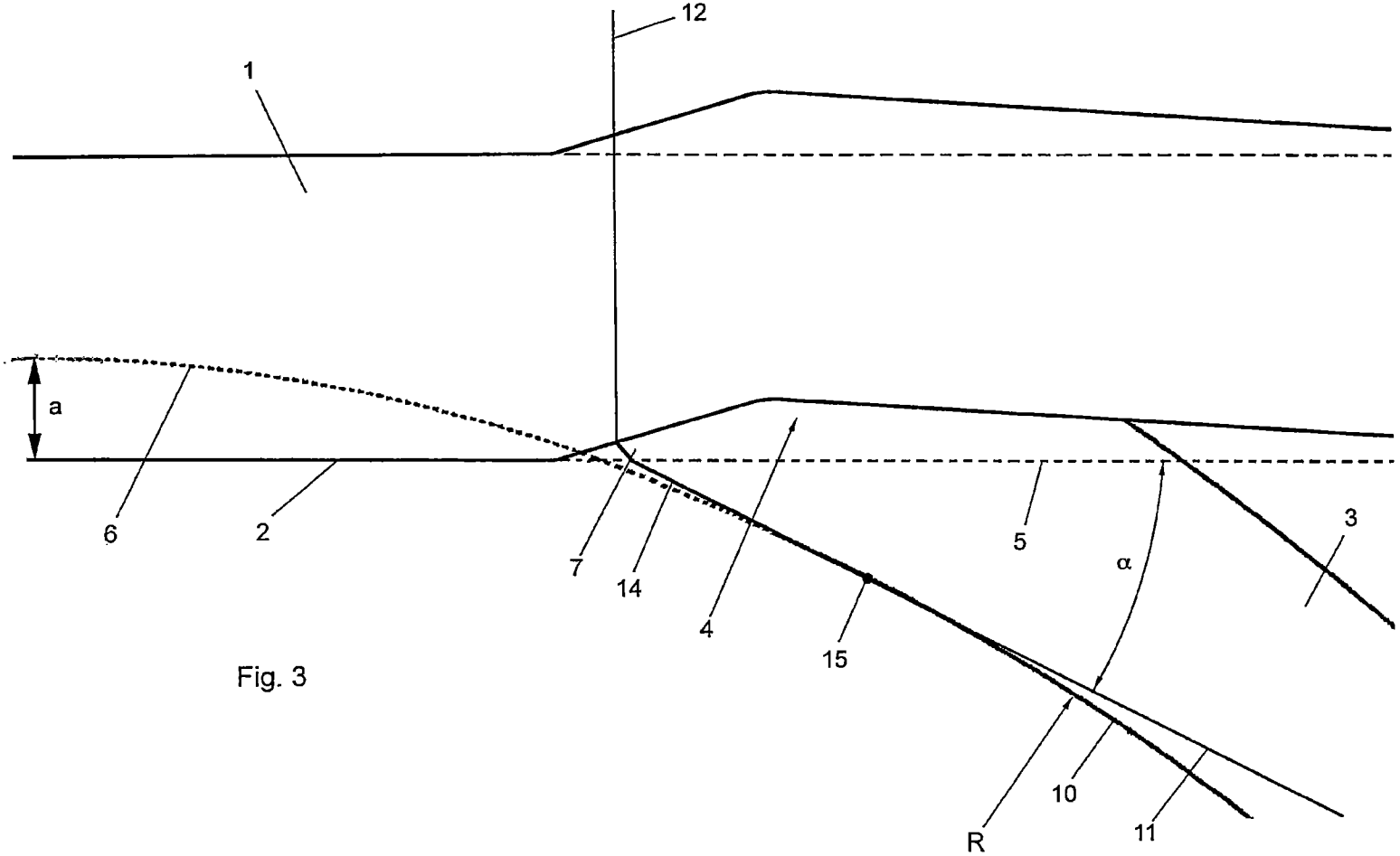
FIG. 3 shows a detail of the illustration in FIG. 2.

FIG. 3 shows the progression of the running edge 10 of the tongue rail 3 in greater detail. The running edge 10 has a curve progression that is defined by the radius R in the example shown such that the curve progression has the shape of an arc of a circle. The imaginary extension 6 of the curve progression accordingly is also defined by the radius R. The running edge 10 could alternatively also have the progression of a clothoid, in which case the imaginary extension 6 would also extend in accordance with this clothoid. In the embodiment according to FIG. 3, the running edge 10 of the tongue rail 3 follows the aforementioned curve progression up to a point 15. At the point 15, the running edge transforms into a straight end section 14, wherein the straight end section corresponds to a tangent 11 that is placed on the curve progression in the point 15. In this case, the angle $\alpha$ between the tangent 11 and the imaginary linear progression 5 of the running edge 2 of the stock rail 1 represents the deflection angle $\alpha$. It is obvious that the deflection angle $\alpha$ is in the case of the straight end section 14 greater than in instances, in which the running edge 10 follows the curve progression up to the tongue rail tip 7.

FIG. 3 furthermore shows that the tongue rail tip 7 of the tongue rail 3 is in accordance with a preferred embodiment of the present invention realized in a flattened fashion and therefore less susceptible to wear.

Figure 4:
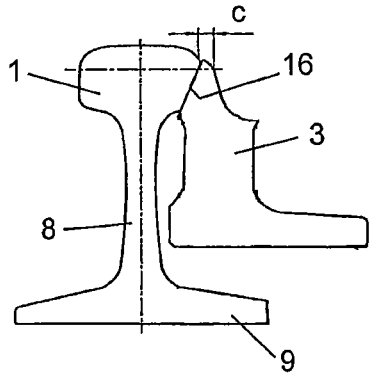
FIG. 4 shows a section along the line IV-IV in FIG. 1.
Figure 5:
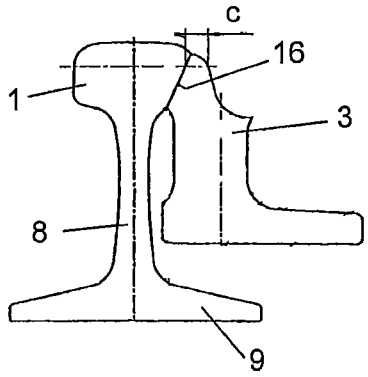
FIG. 5 shows a section along the line V-V in FIG. 2.

FIGS. 4 and 5 show that the stock rail 1 features a chamfer 16 that extends obliquely referred to the web 8 and the base 9, and that the tongue rail 3 may have a shape that corresponds to the chamfer 16.

Figure 6:
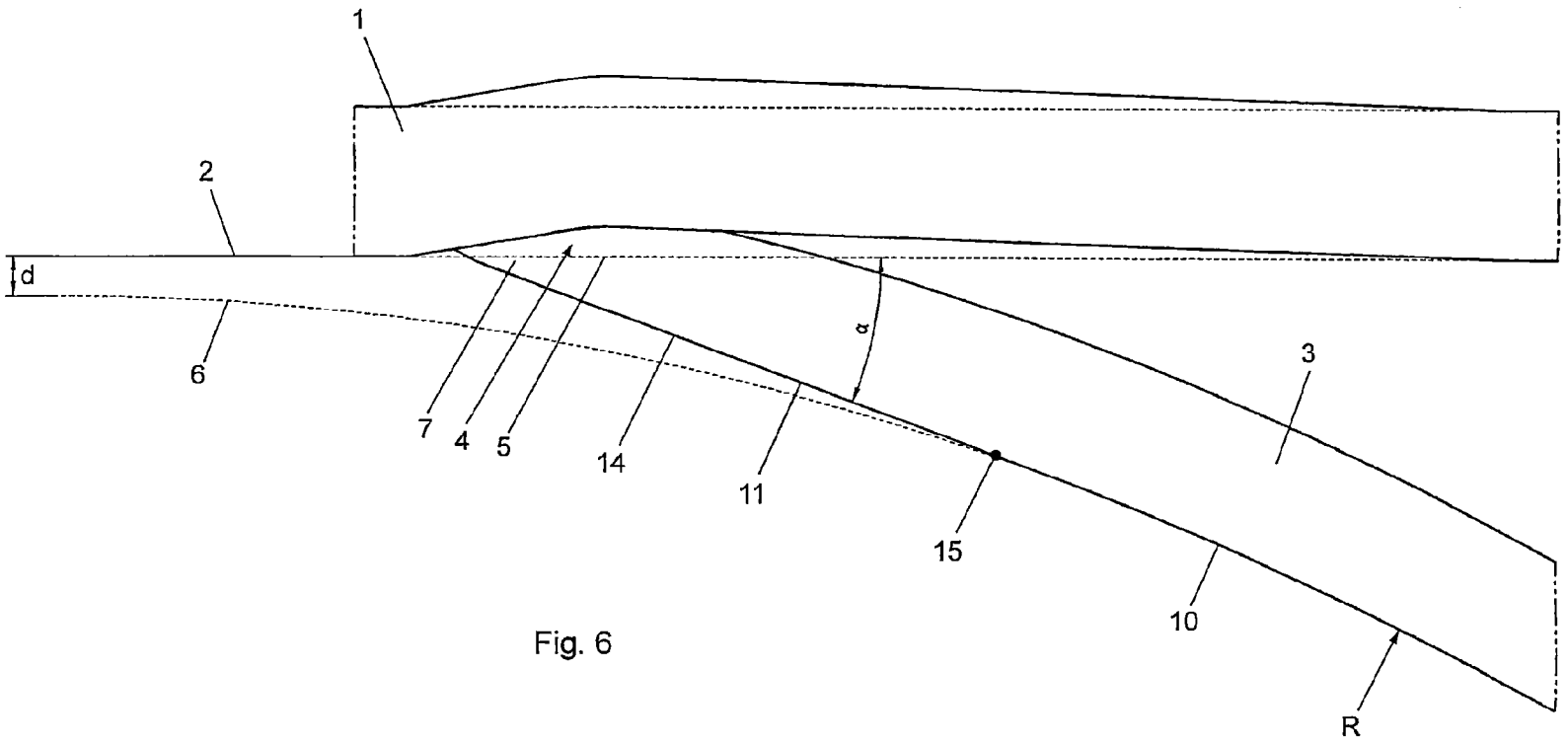
FIG. 6 shows a second exemplary embodiment of the invention.

FIG. 6 shows an alternative embodiment, in which the tongue rail 3 is in contrast to the embodiment according to FIGS. 2, 3 and 5 not realized with an overcutting design, but rather an undercutting design. This means that the imaginary extension 6 of the curve progression of the running edge 10 neither cuts across nor contacts the running edge 2 of the stock rail 1.

The undercutting dimension is identified by the reference symbol d and denotes how far the contact point between the imaginary extension 6 and a line extending parallel to the running edge 2 is shifted forward in comparison with the tangential design of the tongue rail 3 (FIG. 1). The running edge 10 follows the curve progression up to a point 15, at which the running edge 10 transforms into a straight end section 14, wherein the straight end section corresponds to a tangent 11 that is placed on the curve progression in the point 15. In this case, the angle $\alpha$ between the tangent 11 and the imaginary linear progression 5 of the running edge 2 of the stock rail 1 represents the deflection angle $\alpha$. In the undercutting design, the deflection angle $\alpha$ and the thickness of the tongue rail in the plane of the running edge are also greater than in the tangential design according to FIG. 1.

Figure 7:
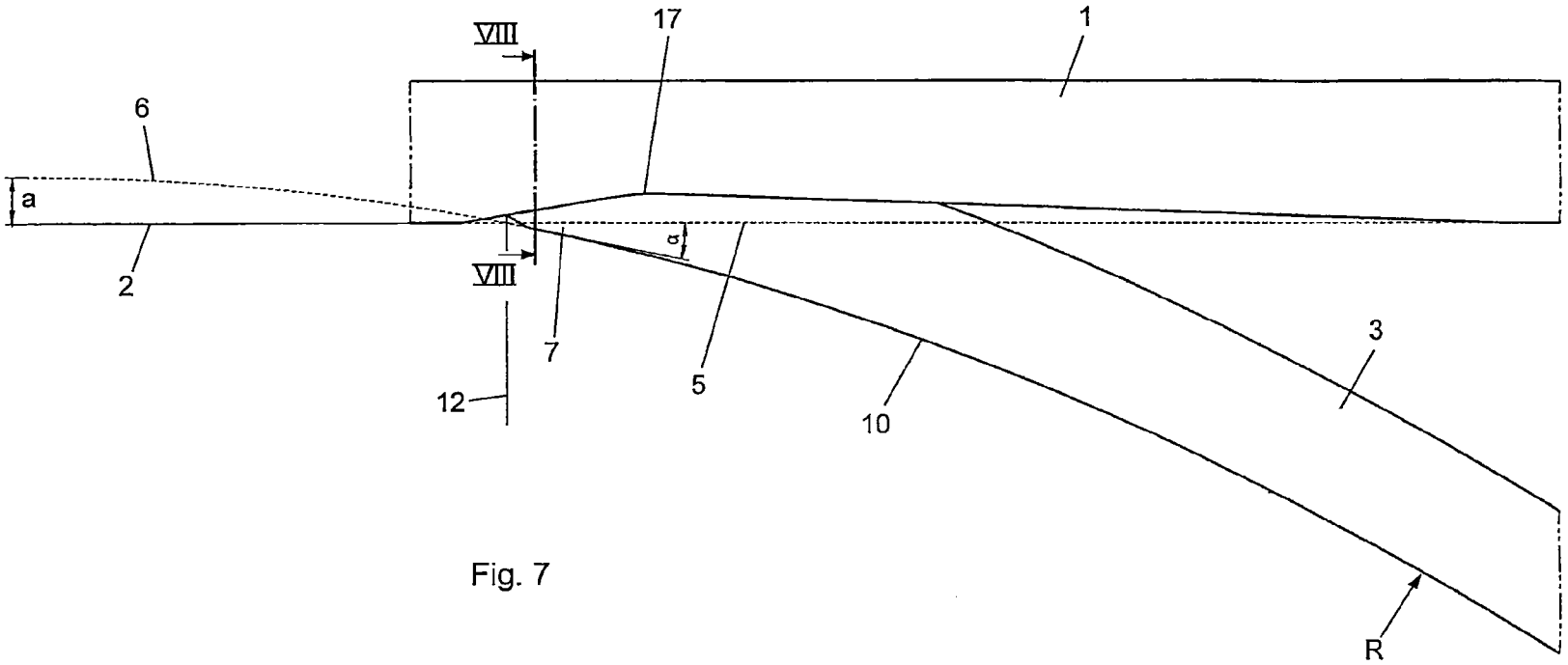
FIG. 7 shows a third exemplary embodiment of the invention.

With respect to the curve progression of the running edge 10 of the tongue rail 3, the modified design according to FIG. 7 corresponds to the design in FIGS. 2 and 5. Consequently, this figure shows an overcutting tongue rail 3. In contrast to the design according to FIGS. 2 and 5, the deviation of the course of the running edge of the stock rail 1 is not realized by deflecting the stock rail 1, but rather by processing one side of the stock rail head in the region of the abutment on the tongue rail 3. This processing is realized in the form of an oblique chamfer 16 (FIG. 8) with such a size that the width of the stock rail head is reduced by 10-15 mm in the plane of the running edge. In the region of its abutment on the tongue rail 3, the stock rail 1 therefore is realized with a rail head width that is reduced in comparison with the region situated outside the abutment, wherein the width of the rail head decreases from the tongue rail beginning 12 up to a point 17, at which the track wheel laterally comes in contact with the tongue rail 3, and increases in the following region. The cross section of the tongue rail 3 is reinforced toward the stock rail 1 in accordance with the reduced width of the stock rail head. Since the reduction of the width of the stock rail cross section and the reinforcement of the tongue rail 3 are not realized uniformly, but rather increase in a first region and decrease in a following second region, it becomes possible to adapt the degree of the reinforcement of the tongue rail 3 to the progression of the lateral force.

The greatest reinforcement of the tongue rail 3 therefore is realized in the sensitive transition area of the load from the stock rail 1 to the tongue rail 3 and in this way increases the cross section and therefore the moment of inertia of the tongue rail 3 such that the tongue rail 3 can better withstand the higher transversal forces. Due to the preferably steady cross-sectional change, an abrupt gauge change is prevented such that the traveling comfort is not negatively influenced and an impact load on the rails is avoided.

Figure 8:
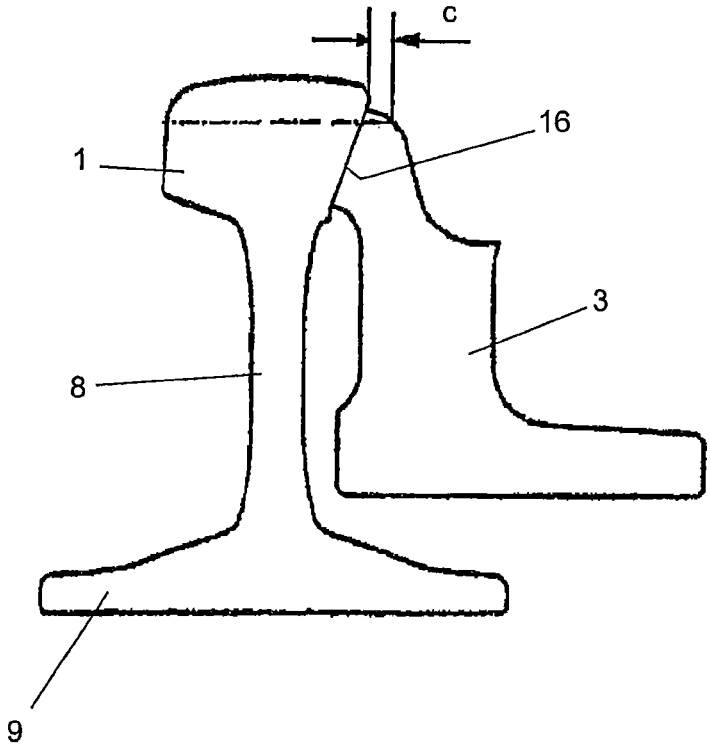
FIG. 8 shows a section along the line VIII-VIII in FIG. 7.

The design according to FIGS. 7 and 8 may also be realized with an undercutting tongue rail 3.

It should generally be noted that the invention is not limited to the cooperation of a tongue rail with a stock rail that has a straight rail progression. In fact, the invention is also suitable for a curved progression of the stock rail such as, e.g., on similar flexure turnouts.

The invention claimed is:

1. A railway switch with a main track and a branch track, wherein one rail of each track is each configured as a tongue rail and movable into abutment on the respective stock rail, wherein the stock rail comprises a deviating course of a running edge in an abutment region of the tongue rail and a running edge of the tongue rail comprises a curve progression, whose imaginary extension comprises an overcutting or undercutting with the running edge of the stock rail.

2. The railway switch according to claim 1, wherein the stock rail is in the abutment region of the tongue rail deflected from its rail progression such that a bulge is formed.

3. The railway switch according to claim 1, wherein the tongue rail comprises an end section with a straight running edge that follows the curve progression.

4. The railway switch according to claim 3, wherein the straight running edge of the end section tangentially follows the curve progression.

5. The railway switch according to claim 1, wherein the running edge of the tongue rail includes a deflection angle of 0.3° to 0.8° with the running edge of the stock rail.

6. The railway switch according to claim 1, wherein the running edge of the tongue rail includes a deflection angle of 0.4° with the running edge of the stock rail.

7. The railway switch according to claim 1, wherein the tongue rail has in the abutment region a shape that corresponds to the deviating course of the running edge of the stock rail.

8. The railway switch according to claim 2, wherein the tongue rail has in the abutment region a shape that corresponds to the bulge.

9. The railway switch according to claim 1, wherein the tongue rail features a flattened tongue rail tip.

10. The railway switch according to claim 2, wherein a tongue rail tip of the tongue rail lies within the bulge of the stock rail when the tongue rail is in abutment on the stock rail.

11. The railway switch according to claim 1, wherein the stock rail comprises underneath the running edge a chamfer that obliquely extends toward the web and toward the base of the stock rail, and in that the tongue rail has a shape that corresponds to the chamfer.

12. A railway switch with a main track and a branch track, wherein one rail of each track is each configured as a tongue rail and movable into abutment on the respective stock rail, wherein the stock rail comprises a deviating course of a running edge in an abutment region of the tongue rail and a running edge of the tongue rail comprises a curve progression, whose imaginary extension comprises an undercutting with the running edge of the stock rail in which the running edge of the tongue rail neither cuts across nor contacts the running edge of the stock rail, the undercutting dimension is designated d and denotes the distance the contact point between the imaginary extension and a line running parallel to the running edge of the stock rail in comparison to a tongue rail that is tangential to the stock rail.

13. The railway switch according to claim 1, wherein the imaginary extension comprises an overcutting with the running edge of the stock rail.

* * * * *